United States Patent [19]

Kinder et al.

[11] Patent Number: 4,457,678

[45] Date of Patent: Jul. 3, 1984

[54] FLUID DRIVE MECHANISM

[75] Inventors: Mark R. Kinder, Lafayette, Ind.; David S. Moorman, Coal Valley, Calif.

[73] Assignee: TRW Inc., Cleveland, Ohio

[21] Appl. No.: 351,966

[22] Filed: Feb. 24, 1982

[51] Int. Cl.[3] ..... F03C 2/08; F16D 31/02; F15B 15/00

[52] U.S. Cl. ..... 418/61 B; 60/369; 60/384; 91/40

[58] Field of Search ..... 418/61 B; 60/384, 369; 91/40

[56] References Cited

U.S. PATENT DOCUMENTS 198,610 12/1877 Harrison ..... 91/40
3,289,602 12/1966 Hudgens ..... 418/61 B
4,280,396 7/1981 Zeuner et al. ..... 91/320

FOREIGN PATENT DOCUMENTS 47-11288 8/1972 Japan ..... 60/369
128260 8/1959 U.S.S.R. ..... 91/40

*Primary Examiner*—John J. Vrablik
*Attorney, Agent, or Firm*—Yount & Tarolli

[57] ABSTRACT

A mechanism for moving an element in opposite directions includes a piston connected with the element. The piston reciprocates in a cylinder as high pressure fluid is alternately directed against one side or the other of the piston by a rotatable directional valve. The directional valve is rotated by a gerotor motor. A single rotatable valve element has passages at one end which form a commutator valve for the gerotor motor and ports at the other end which form the directional valve. A passage through the valve element connects the output of the gerotor motor with the directional valve ports. Cushioning means are provided to damp the motion of the piston at each end of its stroke to prevent impact with the ends of the cylinder.

15 Claims, 11 Drawing Figures

FLUID DRIVE MECHANISM

BACKGROUND OF THE INVENTION

The present invention relates to a mechanism for moving an element in opposite directions, and in particular the present invention relates to a hydraulic mechanism for reciprocating an element.

Many kinds of devices require motion of an element in first one direction, and then in the opposite direction. For example, in harvesting equipment a cutter bar reciprocates in opposite directions relative to a fixed comb. Also beds for agitating harvested crops are driven in opposite directions.

Various mechanisms including hydraulic mechanisms have been used in the past to reciprocate such elements. One such hydraulic mechanism is described in U.S. Pat. No. 4,280,396. In this mechanism, a piston moves first in one direction and then in the opposite direction as hydraulic fluid is applied alternately to opposite sides of the piston. The flow of hydraulic fluid is controlled by a spool valve which shifts position when the piston reaches one end or the other of its stroke. As the piston approaches an end of its stroke, the piston uncovers a port which allows the fluid pushing on one side of the piston to be communicated to one end of the spool valve to shift the spool valve. The spool valve then reverses the flow of fluid to the other side of the piston.

The mechanism disclosed in U.S. Pat. No. 4,280,396 has an inherent delay in its operation because fluid starts to shift the spool valve when the piston has reached the end of its stroke. Moreover, some time is required for the spool itself to move. In addition, this mechanism requires a special piston construction with lands and grooves to regulate the flow of fluid to the spool valve.

SUMMARY OF THE INVENTION

The present invention is a hydraulic mechanism for moving an element in opposite directions. The mechanism includes fluid motor means including a piston and cylinder for moving the element in opposite directions, a directional valve for directing fluid alternately to opposite sides of the piston, and a fluid motor for moving the directional valve. Specifically, the fluid motor is a gerotor motor which includes an internally toothed outer gear member, an externally toothed inner gear member, and a commutator valve. High pressure fluid is directed to the gerotor motor and causes the gear members to rotate and orbit relative to each other. The directional valve is drivingly connected to one of the gear members and rotates in response to movement of the one gear member.

Preferably, the gerotor motor of the present invention includes an internally toothed stator (fixed gear) and an externally toothed rotor eccentrically mounted within the stator for orbital and rotary motion. The rotor has one less tooth than the stator. Together the stator and rotor define a plurality of expansible and contractible fluid pockets. The commutator valve sequentially directs high pressure fluid to the expanding pockets and communicates the contracting pockets with a fluid outlet.

The commutator valve is rotatable and driven by the rotor. The commutator valve includes an end portion of a generally cylindrical valve element which turns about the axis of the stator. This end portion of the cylindrical valve element includes two series of slots, one connected with a high pressure supply of hydraulic fluid and the other connected with the fluid outlet from the gerotor motor. The slots in this end portion of the cylindrical valve element communicate with the fluid pockets through passages in a manifold plate.

The directional valve is formed at the end portion of the cylindrical valve element opposite from the commutator slots. The directional valve includes a high pressure port and a low pressure port. The outlet flow from the gerotor motor is collected in a central passage in the cylindrical valve element and flows to the high pressure port. The low pressure port communicates with a return line to a fluid reservoir. These two ports in the cylindrical valve element communicate alternately with a pair of openings leading to opposite sides of the piston as the cylindrical valve element rotates.

Because the directional valve is actuated by the gerotor motor, and not by the piston as in U.S. Pat. No. 4,280,396, there is less time delay in reversing the direction of the piston, and no special machining of the piston is required. Moreover, because the directional valve is a rotary valve, there is no change in the direction of movement of the valve and thus little inertia associated with its operation.

BRIEF DESCRIPTION OF THE DRAWINGS

Other features and advantages of the present invention will become apparent to those skilled in the art to which the present invention relates from the following description of a preferred embodiment of the invention made with reference to the accompanying drawings wherein.

DESCRIPTION OF PREFERRED EMBODIMENT

Figure 1:
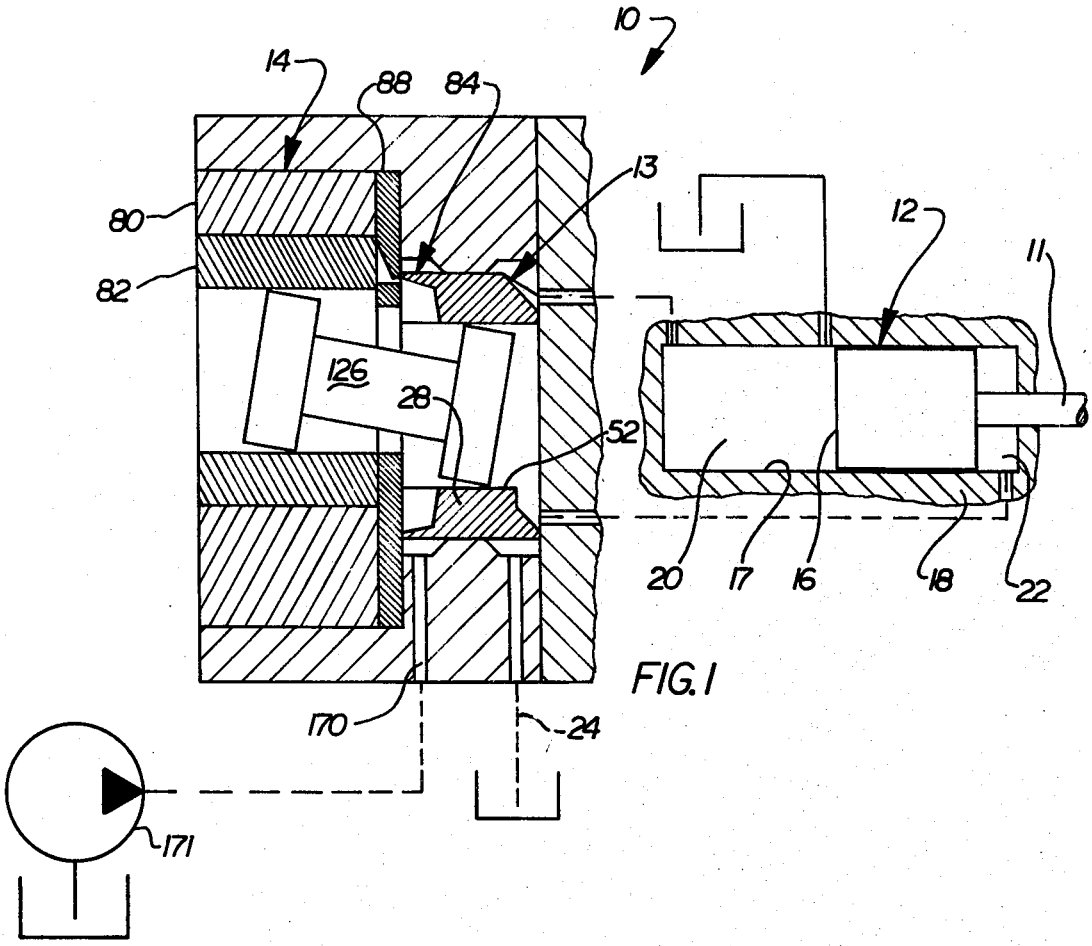
FIG. 1 is a schematic illustration of a mechanism constructed in accordance with the present invention.

The present invention comprises a mechanism 10 (FIG. 1) for moving an element 11 in opposite directions. The mechanism 10 includes a fluid motor 12 for moving the element 11 in opposite directions. The mechanism 10 also includes a directional valve 13 for controlling the flow of fluid to the fluid motor 12. The mechanism 10 further includes a rotary fluid motor 14, preferably a gerotor motor, for controlling the movement of the directional valve 13.

The fluid motor 12 (FIG. 2) comprises a piston 16 which is reciprocatable in a bore 17 in a cylinder housing or member 18. The element 11 is screwed into the piston 16 and extends through a plug 19 which closes one end of the bore 17. The plug 19 is screwed into the cylinder member 18. Seals 25 are provided where the element 11 passes through the plug 19.

The piston 16 and cylinder member 18 define two chambers 20 and 22 at opposite sides of the piston 16. When fluid under pressure is introduced into one of the chambers 20 and 22 and the other of the chambers is connected with a return line 24, the piston 16 moves in one direction. When the connections are reversed, the piston 16 moves in the opposite direction.

The directional valve 13 controls the motion of the piston 16 and the output element 11 by alternately communicating the opposite chambers 20 and 22 with a source of high pressure fluid and the low pressure return line 24. The directional valve 13 (FIG. 2) includes a rotatable valve element 28. The valve element 28 has a cylindrical outside surface 30 which rotates within a cylindrical bore 32 in a valve housing member 34. An end face 36 of the valve housing member 34 defines the end of the bore 32 and is disposed in tight engagement with the end face 38 of the cylinder member 18. Bolts 40 hold the valve housing member 34 and cylinder member 18 together. A seal 42 is provided between the valve housing member 34 and the cylinder member 18. End face 44 of the valve element 28 is normal to the axis of bore 32 and rotates against the end face 38 of the cylinder member 18.

Figure 6:
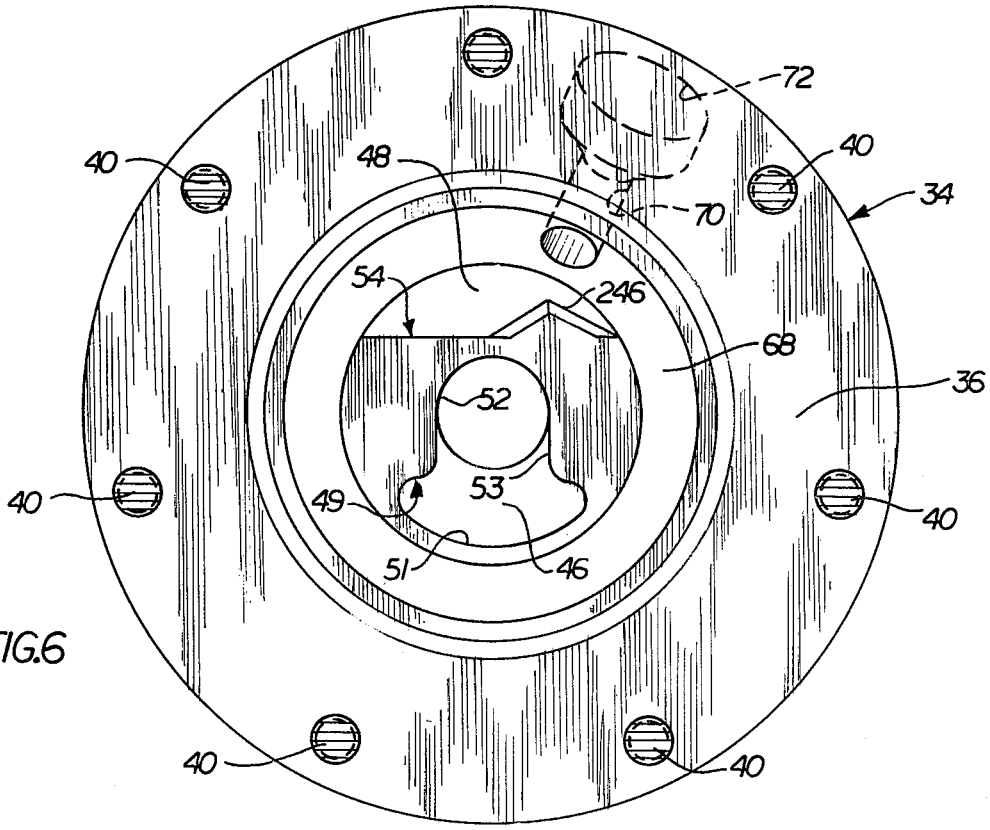
FIG. 6 is a sectional view taken along line 6—6 of FIG. 2 with parts omitted.

A high pressure port 46 and a low pressure port 48 are openings formed in an end portion 50 of the valve element 28. The high pressure port 46 is defined by a kidney-shaped wall 49 having a portion 51 concentric with the axis of the valve member 28 and a radial extension 53 connecting the port 46 with a central passage 52 through the valve element. High pressure fluid is directed through the central passage 52 to the high pressure port 46. The low pressure port 48 (FIG. 6) is an opening in the end face 44 of the valve element which is formed by a wall 54 which extends generally chordally across the end face 44 of the valve element 28.

The low pressure port cooperates with an annular recess 68 (FIG. 2) which is formed in the valve housing member 34. The annular recess 68 circumscribes the end portion 50 of the valve element 28 in which the high and low pressure ports 46 and 48 are formed. A passage 70 leads from the recess 68 to a threaded outlet connection 72 to which the return line 24 is connected. Thus, the low pressure port 48 is in continuous communication with the return line 24.

Figure 7:
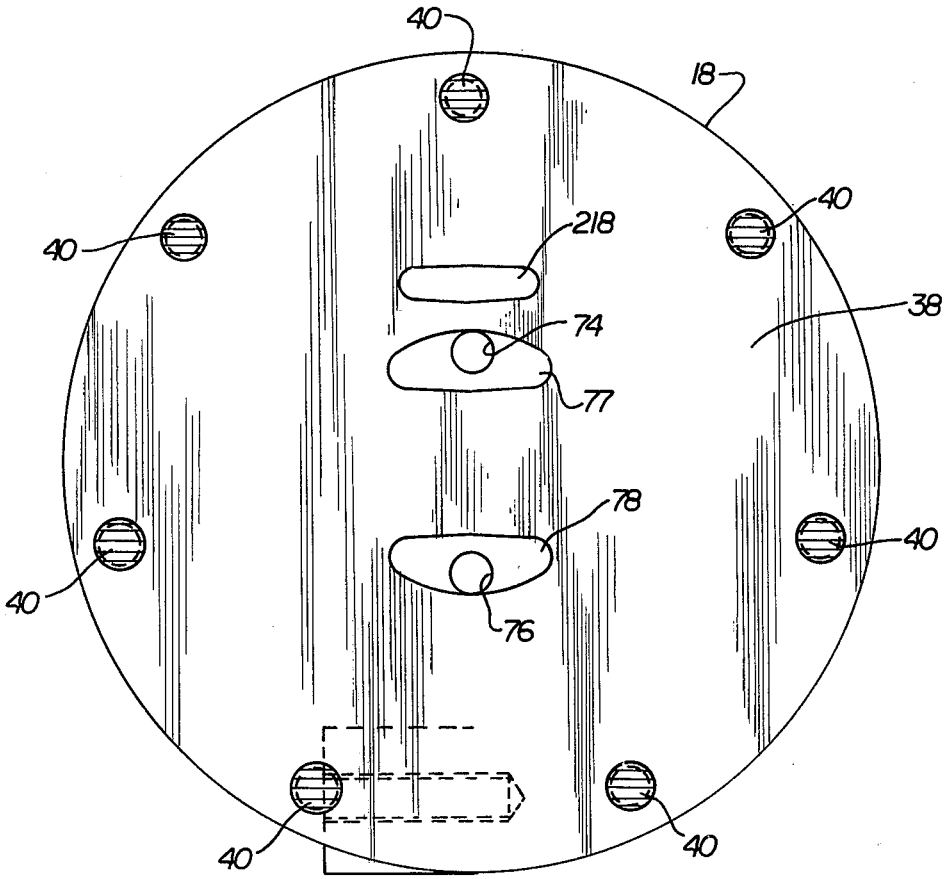
FIG. 7 is a sectional view taken along line 7—7 of FIG. 2.

As the valve element 28 rotates, the high and low pressure ports communicate alternately with passages 74 and 76 in the cylinder member 18, which passages 74, 76 lead to expansible chambers 20 and 22, respectively. The passages 74 and 76 terminate in arcuate openings 77 and 78 (FIG. 7), respectively, in the end face 38 of the cylinder member 18. The openings 77 and 78 cooperate with the ports 46 and 48 (FIG. 2) to alternately connect the chambers 20 and 22 with high and low fluid pressure as the valve element 28 rotates, as will be described more fully below.

The mechanism 10 also includes the rotary fluid motor 14, which preferably is a gerotor motor, which rotates the valve element 28. The gerotor motor 14 includes an internally toothed gear 80 and an externally toothed gear 82 which in the preferred embodiment is the output element of the motor 14. The two gears have relative orbital motion and relative rotary motion, and one of these motions is used to drive the valve member 28. In the preferred embodiment the internally toothed gear 80 is a stator (fixed gear) and the externally toothed gear 82 is a rotor which has one less tooth than the stator.

The stator and rotor are disposed within a gerotor housing member 85 and are mounted between end plate 86 and a manifold plate 88. Bolts 90 fasten the end plate 86, rotor housing 85, and manifold plate 88 firmly against end face 92 of the valve housing member 34, which is parallel with end face 36 of the valve housing member 34. Seals 94 and 96 are provided between the end plate 86 and the rotor housing 85 and between the rotor housing 85 and the valve housing member 34, respectively.

Figure 3:
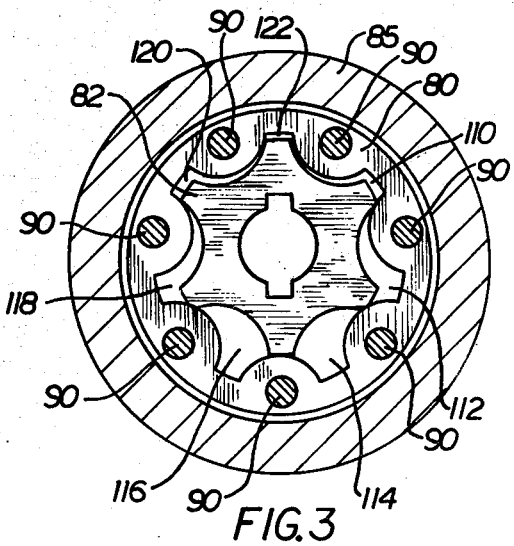
FIG. 3, on sheet 1 of the drawings, is a view taken generally along line 3—3 of FIG. 2 and with parts omitted.

The stator 80 and rotor 82 define pockets 110, 112, 114, 116, 118, 120 and 122 (FIG. 3) which expand and contract as the rotor 82 orbits and rotates inside the stator 80. Assuming a counterclockwise rotary movement and a clockwise orbital movement of the rotor 82 as viewed in FIG. 3, the pockets 110, 112 and 114 are contracting pockets, while pockets 116, 118 and 120 are expanding pockets. Pocket 122 has completed its contraction and is about to become an expanding pocket.

Figure 4:
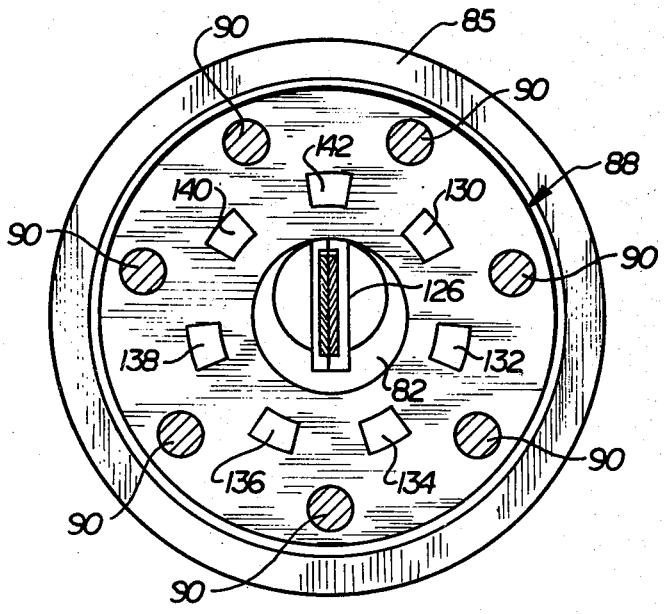
FIG. 4 is a sectional view taken along line 4—4 of FIG. 2.

A commutator valve 84 directs fluid to the expanding pockets and from the contracting pockets. The commutator valve 84 is formed in the end portion 124 of the valve element 28 opposite from the end portion 50. The end face 125 of the valve element 28 is parallel with the opposite end face 44 of the valve element and abuts the manifold plate 88. A drive link 126 connects the rotor 82 with the valve element 28 and transmits rotary motion of the rotor 82 to the valve element. The manifold plate 88 (FIG. 4) includes seven axial passages 130, 132, 134, 136, 138, 140 and 142 which communicate with the pockets 110–122 (FIG. 3), respectively.

Figure 5:
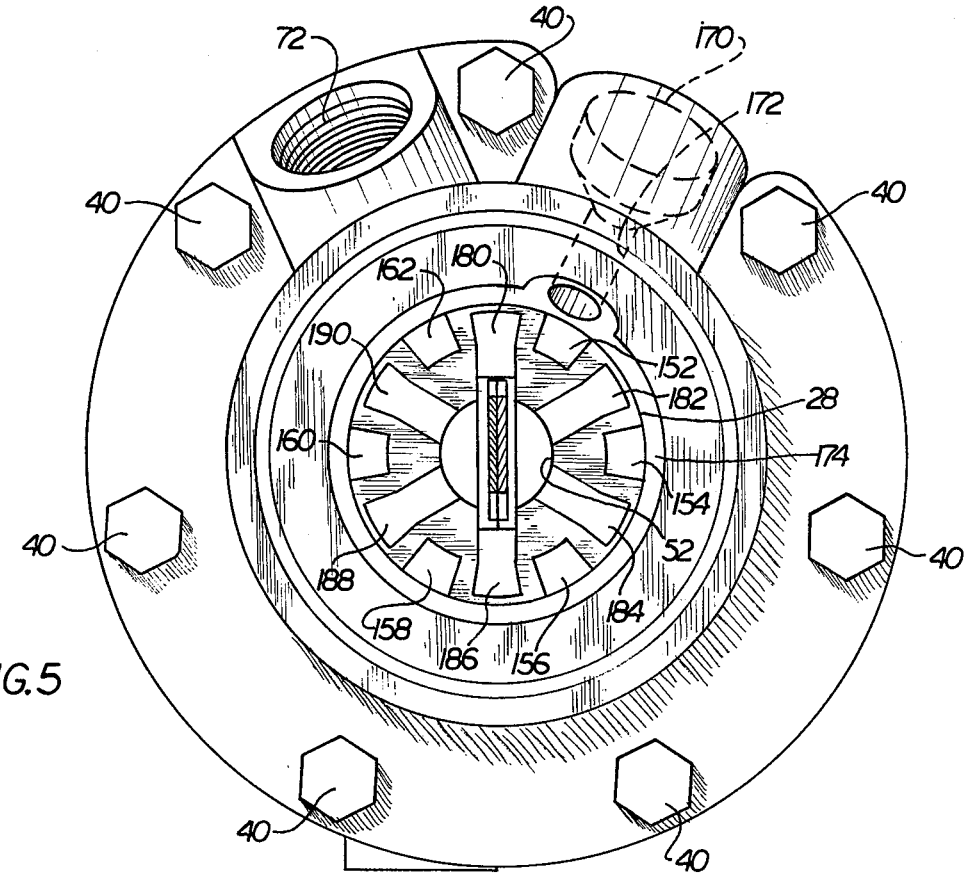
FIG. 5 is a sectional view taken along line 5—5 of FIG. 2.

The end portion 124 (FIG. 2) of the valve element 28 adjacent the manifold plate 88 includes six inlet slots 152, 154, 156, 158, 160 and 162 (FIG. 5). The inlet slots 152–162 are spaced evenly about the outer periphery of the valve element 28 and extend axially about one quarter the length of the valve element 28. The inlet slots 152–162 align with each of the passages 130–142 (FIG. 4) in the manifold plate 88 sequentially as the valve element 28 turns.

Each of the inlet slots 152–162 (FIG. 5) is continuously supplied with high pressure fluid. A threaded inlet port 170 is formed in the valve housing member 34 through which hydraulic fluid from a suitable source, such as pump 171 (FIG. 1), is supplied to the mechanism 10. (For the purposes of clarity in FIG. 2, the inlet connection 170 is shown displaced approximately 180° from its true circumferential position which is shown in FIG. 5.) A passage 172 connects the inlet port 170 with an annular recess 174 formed in the valve housing member 34 and which circumscribes the end portion 124 of the valve element 28. Therefore, there is continuous fluid communication between the inlet connection 170 and the inlet slots 152–162 in the valve element 28.

Figure 2:
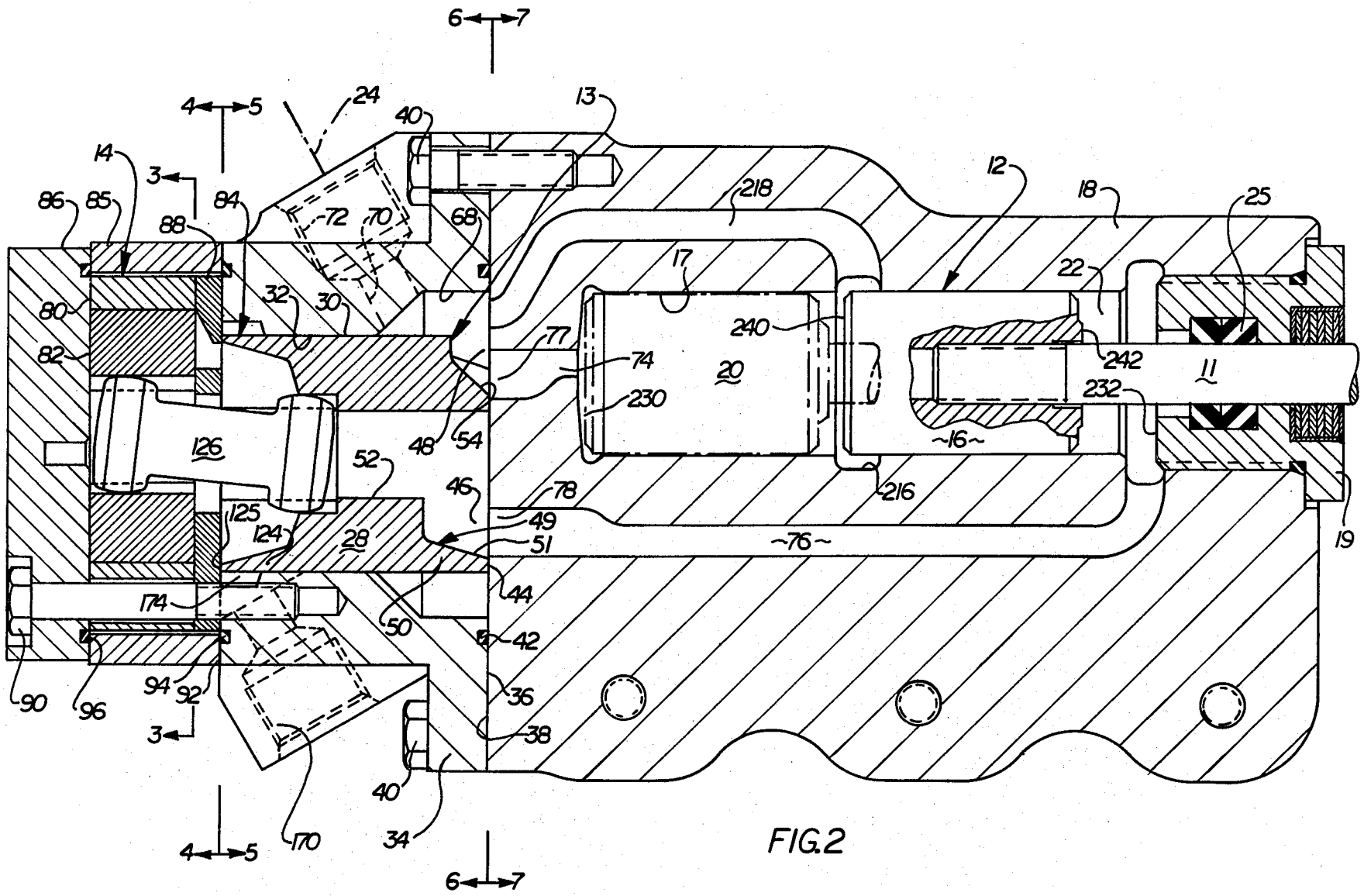
FIG. 2 is a longitudinal sectional view through a mechanism constructed in accordance with the present invention with certain portions displaced circumferentially from their correct position for purposes of clarity.

The end portion 124 (FIG. 2) of the valve element 28 also includes six outlet slots 180, 182, 184, 186, 188 and 190 (FIG. 5) which are spaced evenly between the inlet slots 152–162. The outlet slots 180–190 communicate sequentially with the passages 130–142 (FIG. 4) through the manifold plate 88 as the valve element 28 (FIG. 2) rotates. In addition, each of the outlet slots 180–190 (FIG. 5) is in continuous communication with the central cylindrical passage 52 through the valve element 28 which forms the outlet from the gerotor motor 14 (FIG. 2).

Therefore, it can be seen that the stator 80, rotor 82, manifold plate 88, drive link 126 and the end portion 124 of the valve element 28 cooperate to form a gerotor motor. When high pressure hydraulic fluid is supplied through inlet connection 170, the valve element 28 rotates within the valve housing 34 at the speed of rotation of the rotor 82, and the outlet flow from the motor is through outlet slots 180–190 and into passage 52 through the valve element which may therefore be termed the gerotor outlet.

Fluid flow from the outlet passage 52 of the gerotor motor is into directional valve 13. From the directional valve 13, the fluid flow is, depending on the angular position of the valve element 28, into either passage 74 or passage 76 in cylinder member 18. When the directional valve 13 communicates fluid flowing through the outlet 52 of the gerotor motor 14 with one of the passages 74 and 76, the other of the passages 74 and 76 is connected with the return line 24. This produces reciprocating movement of piston 16 and output element 11 as the valve element 28 rotates.

Figure 8:
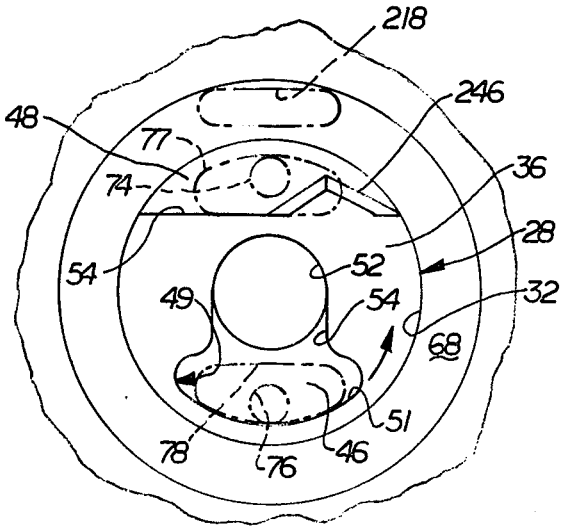
FIGS. 8–11 illustrate a series of operating positions of portions of the structure of FIG. 2.

FIGS. 8–11 illustrate the cooperation between the end portion 50 of the valve element 28 and the openings 77 and 78 of passages 74 and 76 through the cylinder member 18 as the valve element rotates. In FIG. 8, the high pressure port 46 is aligned with opening 78 and thus directs fluid from the outlet 52 of the gerotor motor 14 through passage 76 to chamber 22 (FIG. 2) to move the output element 11 to the left as viewed in FIG. 2. Fluid expelled from the contracting chamber 20 flows through passage 74, through opening 77 and the low pressure port 48 to the return line 24. Accordingly, the piston 16 moves to the left as viewed in FIG. 2.

Figure 9:
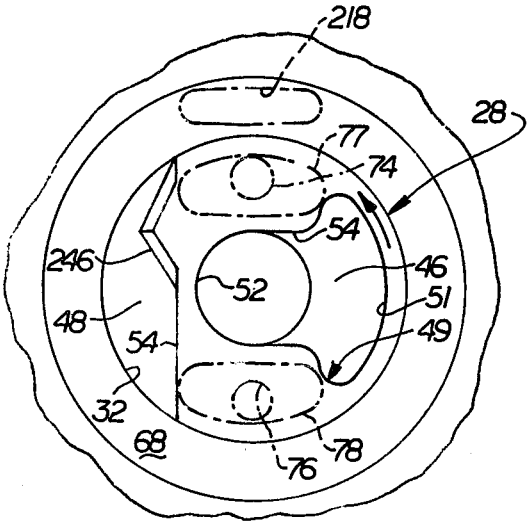

In FIG. 9, the gerotor motor 14 has turned the valve element 28 approximately 90 degrees, by which time the piston 16 will have moved nearly to its extreme leftmost position (shown in phantom in FIG. 2). At this point, the high pressure port 46 and the low pressure port 48 and the openings 77 and 78 are in an edge-to-edge relationship in which there is no overlap. Momentum of the moving parts and inevitable small leakages will move the valve element 28 the next increment of rotation so that fluid again flows through the gerotor motor 14 to turn the valve element.

Figure 10:
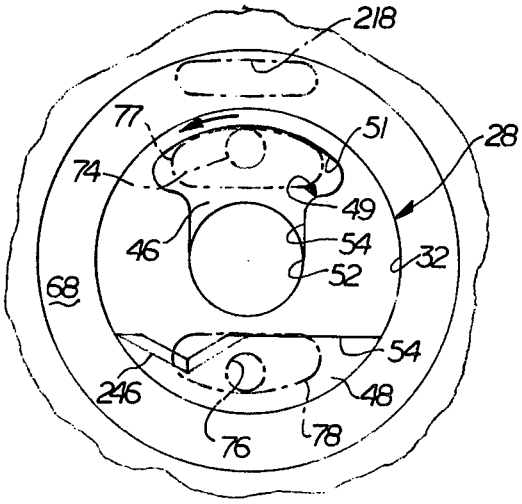
Figure 11:
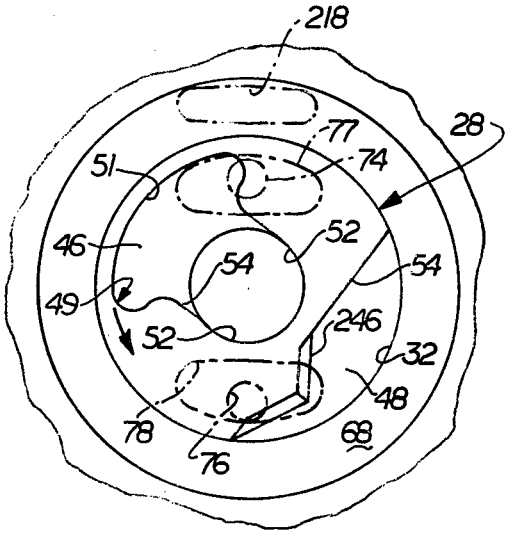

By the time the gerotor motor 13 (FIG. 2) has turned the valve element 28 another 90 degrees, it is in the position illustrated in FIG. 10. There is communication from the outlet 52 of the gerotor motor 13 through the high pressure port 46 and opening 77 into the passage 74 which communicates with the chamber 20. Simultaneously, there is communication from the passage 76 through opening 78 and the low pressure port 48 into the annular recess 68 and from the recess 68 (FIG. 2) through the passage 70 to the outlet port 72. Accordingly, high pressure fluid is directed into chamber 20 while chamber 22 is communicated with the outlet connection 72 and the piston is moved to the right as viewed in FIG. 2.

The mechanism 10 includes means for cushioning the movement of the reciprocating piston 16 to eliminate impact of the piston against the end wall 230 of the bore 17 or against end face 232 of plug member 19 which closes the opposite end of the bore. An annular groove 216 circumscribes the axial mid-portion of the bore 17 in the cylinder member 18. Groove 216 is in continuous communication with the recess 68 in the valve housing member 34 (and thus with return line 24) through a passage 218 in the cylinder member 18. When the directional valve 13 reaches the position shown in FIG. 10, the piston 16 starts moving from the phantom position in FIG. 2 toward the right because of high pressure fluid flowing from the gerotor motor outlet 52 through passage 74 into chamber 20. When end face 240 of the piston reaches the annular groove 216, fluid from chamber 20 is vented to the return line 24 through passage 218. Once the piston 16 has reached this position, the pressures in chambers 20 and 22 at opposite sides of the piston are equal and only the momentum of the moving parts carries the piston farther to the right. This same action occurs when the piston moves toward the left toward the phantom position.

To prevent the momentum of piston 16, output element 11, and whatever implement may be attached to the output element from carrying the piston end face 242 into contact with end face 232 of the plug 19, the flow out of chamber 22 is gradually restricted. To this end, the wall 54 defining the low pressure port 48 includes a beveled surface 246 which sweeps across the opening 78 to slowly close off the return flow from chamber 22. By the time the piston 16 reaches the position shown in solid in FIG. 2, the beveled surface 246 is gradually decreasing the flow from chamber 22 through passage 76 and opening 78 (see FIG. 11). By restricting the flow out of the contracting chamber 22, the movement of the piston 16 is damped and contact between the leading face 242 of the piston and the end face 232 of plug 19 is prevented. A similar damping occurs when the piston 16 moves in the opposite direction as the beveled edge 246 sweeps across opening 77. The exact contour of the beveled edge 246 and where along the stroke of the piston 16 its effects are felt may be varied according to the mass of the implement connected with output element 14 and the speed of operation of the mechanism 10, as can be readily appreciated by those skilled in the art. Generally it is expected that the effects of the beveled edge in restricting flow through the low pressure port 48 will occur relatively near the end of the stroke of the piston and after the trailing face of the piston 16 has uncovered the groove 216 to equalize the pressure on opposite sides of the piston.

Having described a specific preferred embodiment of the invention, the following is claimed:

1. A mechanism for moving an element in opposite directions, said mechanism comprising fluid motor means including at least one piston member and one cylinder member defining first and second expansible chambers, said piston member and cylinder member moving in one direction relative to each other when the first chamber is expanded and moving in the opposite direction relative to each other when the second chamber is expanded, a valve element having a high pressure port through which fluid is directed to the chamber that expands and a low pressure port through which fluid is directed from the chamber that contracts, a fluid motor operatively connected to said valve element for moving said valve element to alternately communicate said high and low pressure ports with said first and second expansible chambers upon movement of said valve element to effect relative movement of said piston member and cylinder member in opposite directions, said fluid motor having a fluid inlet for communication with a fluid source and a fluid outlet, and means defining a fluid conduit for communicating said fluid outlet with said high pressure port of said valve element.

2. A mechanism as set forth in claim 1 wherein said fluid motor for moving said valve element is a gerotor motor.

3. A mechanism as set forth in claim 2 wherein said gerotor motor includes an internally toothed gear and an externally toothed gear, said gears being disposed for relative orbital and rotary movement, and means for connecting one of said gears with said valve element to effect movement of said valve element.

4. A mechanism as set forth in claim 3 wherein said valve element is rotatable and said fluid motor is effective to rotate said valve element.

5. A mechanism as set forth in claim 1 further including cushioning means for dampening relative movement of said piston and cylinder after said piston and cylinder have started relative movement in one direction and before said piston and cylinder reverse their direction of relative movement.

6. A mechanism as set forth in claim 5 wherein said cushioning means includes means for gradually reducing the rate of flow through said low pressure port from the contracting one of said expansible chambers after said piston and cylinder have started relative movement in one direction and prior to their reversing of their direction of relative movement.

7. A mechanism for effecting reciprocating movement of an output element, said mechanism comprising at least one piston and cylinder for moving said element and defining first and second expansible chambers, a valve element, said valve element having first and second pressure ports and being rotatable to alternately communicate said first and second ports with said first and second chambers, a rotary fluid motor having a rotatable output member, and means for transmitting rotary movement of said output member to said valve element to rotate said valve element, said means for transmitting rotary movement comprising a drive link between said output member and said valve element.

8. A mechanism as set forth in claim 7 wherein said first and second pressure ports comprise high and low pressure ports, said rotary motor including a fluid inlet and an outlet, and said mechanism further includes means for communicating fluid from said outlet to said high pressure port of said valve element.

9. A mechanism as set forth in claim 8 wherein said fluid motor is a gerotor motor having a manifold plate, a commutator valve disposed in abutting engagement with said manifold plate, said commutator valve including first and second sets of passages formed in said valve element and communicating sequentially with said passages in said manifold plate as said valve element rotates.

10. A mechanism as set forth in claim 9 wherein said first and second sets of passages in said valve element and said high and low pressure ports in said valve element are disposed in opposite end portions of said valve element.

11. A mechanism for effecting movement of an element in opposite directions, said mechanism comprising (a) a gerotor motor including an internally toothed gear member and an externally toothed gear member located eccentrically within said internally toothed gear member and having one less tooth than said internally toothed gear member, said gear members having relative rotatable and orbital movement, the teeth of said rotor and stator defining expansible and contractible fluid pockets, and commutator valve means for directing high pressure fluid to the fluid pockets as they are expanding to effect relative rotation of the gear members and for directing high pressure fluid from the pockets as they are contracting, (b) an expansible chamber fluid motor connected with said element and having a piston and cylinder defining a pair of expansible chambers, (c) directional valve means movable to alternately (i) deliver high pressure fluid from the commutator valve means to one of said pair of expansible chambers and permit fluid to flow out of the other of said pair of expansible chambers and (ii) deliver high pressure fluid from the commutator valve means to the other of said pair of expansible chambers and permit fluid to flow out of the one chamber thereby effecting movement of said element in opposite directions, and (d) means connecting one of said gear members with said directional valve means to effect said movement of said directional valve means in timed relation to at least one of said relative movements of said gear members.

12. A mechanism as set forth in claim 11 wherein said internally toothed gear is fixed and said externally toothed gear rotates and orbits relative to said internally toothed gear, and said means connecting one of said gear members with said directional valve comprises a drive link connecting said externally toothed gear to said directional valve to rotate said directional valve upon rotation of said externally toothed gear.

13. A mechanism as set forth in claim 12 wherein said commutator valve means includes first and second sets of passages formed in a first end portion of a valve element and said directional valve means includes a high pressure port and a low pressure port formed in a second end portion of said valve element opposite from said first end portion.

14. A mechanism as set forth in claim 13 wherein said valve element includes first and second parallel end faces and is rotatable about an axis normal to said end faces, said high and low pressure ports forming openings in said second end face, and wherein said mechanism further comprises housing means having a surface abutting said second end face, first and second passage means in said housing means for communicating fluid from said surface to said expansible chambers, each of said first and second passage means including an opening in said surface.

15. A mechanism as set forth in claim 14 wherein the gerotor motor further includes a manifold plate disposed in abutting engagement with said first end surface of said valve element, said manifold plate having a plurality of passages therethrough each of which communicates with one of said expansible and contractible fluid pockets in said gerotor motor, and passage means connecting one of said sets of passages of said commutator valve means in said first end portion of said valve element with said high pressure port in said second end portion of said valve element.

* * * * *